US006241070B1

(12) United States Patent
Loder

(10) Patent No.: US 6,241,070 B1
(45) Date of Patent: Jun. 5, 2001

(54) SYSTEMS FOR THE CONVEYANCE OF STANDING PASSENGERS

(75) Inventor: John Louis Loder, Castlemaine (AU)

(73) Assignee: Loderway Pty. Limited, Castlemaine (AU)

( * ) Notice: Subject to any disclaimer, the term of this patent is extended or adjusted under 35 U.S.C. 154(b) by 0 days.

(21) Appl. No.: 09/284,740

(22) PCT Filed: Oct. 18, 1996

(86) PCT No.: PCT/AU96/00660

§ 371 Date: Jun. 1, 1999

§ 102(e) Date: Jun. 1, 1999

(87) PCT Pub. No.: WO97/14644

PCT Pub. Date: Apr. 24, 1997

(30) Foreign Application Priority Data

Oct. 18, 1995 (AU) ..... PN 6052

(51) Int. Cl.[7] ..... B65G 43/00
(52) U.S. Cl. ..... 198/323
(58) Field of Search ..... 198/323, 324, 198/325

(56) References Cited

U.S. PATENT DOCUMENTS

| | | | | |
|---|---|---|---|---|
| 2,109,210 | * | 2/1938 | Dunlop | 198/323 |
| 3,074,529 | | 1/1963 | Landschulze | 198/16 |
| 4,088,219 | * | 5/1978 | Binns | 198/323 |
| 4,800,998 | | 1/1989 | Myrick | 198/323 |

FOREIGN PATENT DOCUMENTS

| | | | | |
|---|---|---|---|---|
| 523 832 A1 | | 1/1993 | (EP) . | |
| 594 396 A1 | | 4/1994 | (EP) . | |
| 716 039 A1 | | 12/1996 | (EP) . | |
| 928473 | | 6/1963 | (GB) . | |
| 1031967 | | 6/1966 | (GB) . | |
| 1159589 | * | 7/1969 | (GB) | 198/323 |
| 1319778 | * | 6/1973 | (GB) | 198/325 |
| 2-300089 | * | 12/1990 | (JP) | 198/323 |
| 5-17093 | * | 1/1993 | (JP) | 198/323 |
| WO 92/18414 | | 4/1992 | (WO) . | |

* cited by examiner

*Primary Examiner*—James R. Bidwell
(74) *Attorney, Agent, or Firm*—Seed IP Law Group PLLC

(57) ABSTRACT

A walkway or escalator system for the conveyance of standing passenagers comprises a termination plate associated with the travelling surface and a detector device responsive to the sensing of material ingested between the leading edge of the termination plate and travelling surface so as to shut-off the system in the event that ingestion is detected. Alternatively or in addition the system comprises means for detecting a blockage at the discharge end of the travelling surface as may arise of luggage accumulates at that point or if a passenger falls or is trapped. The detector means operates by sensing the presence of relatively stationary objects or passengers at the discharge end and shuts-off the system if blockage is detected.

6 Claims, 13 Drawing Sheets

FIG 5
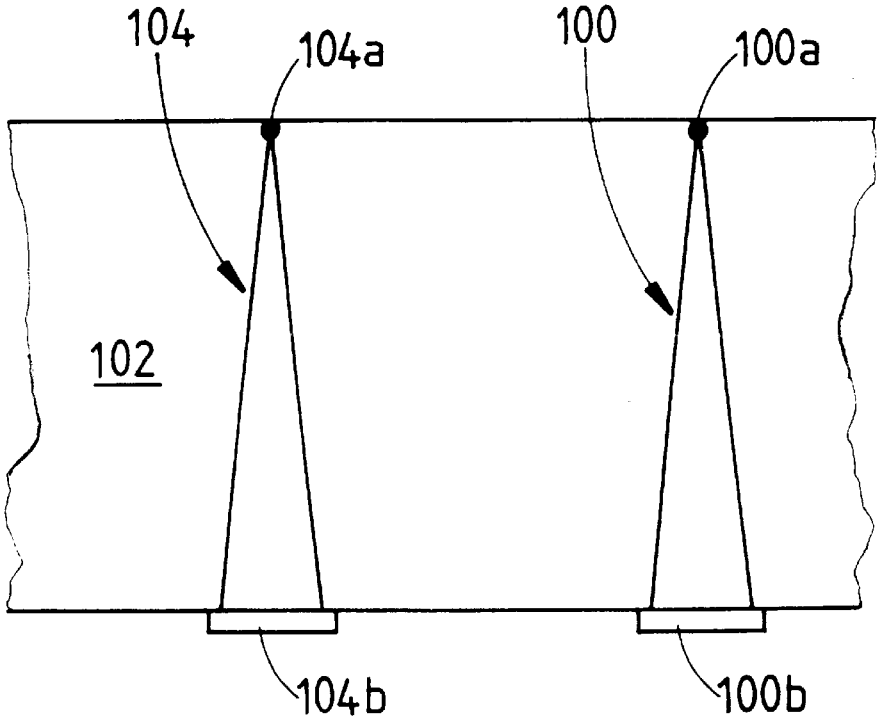
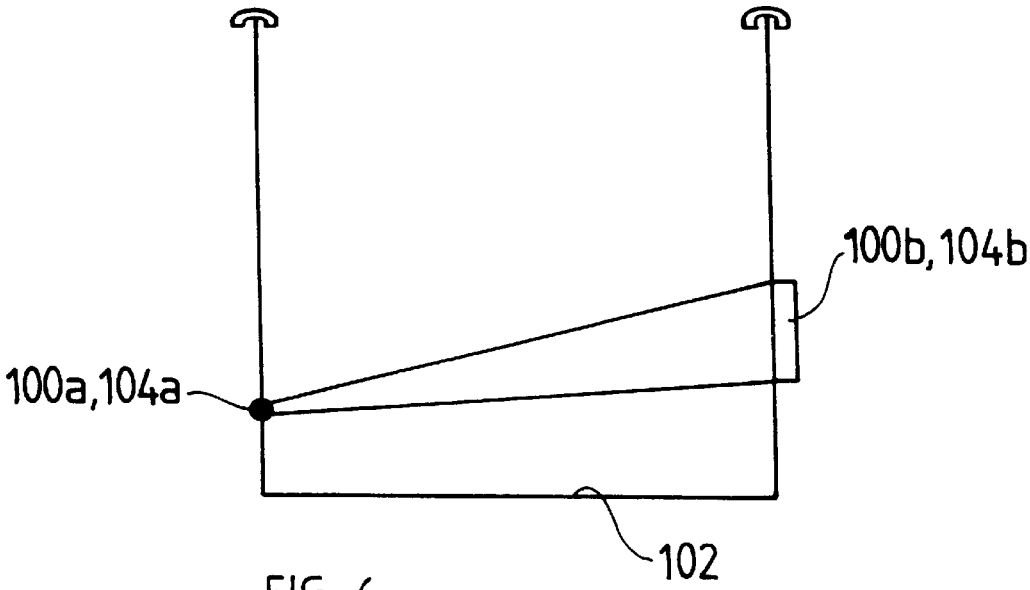
FIG 6

FLOW CHART 1
RESET AND IDLE LOOP

FLOW CHART 2
SPEED SENSE INTERRUPT

FLOW CHART 3
4 MILLISECOND TIMER INTERRUPT

FLOW CHART 5
CHECK ROUTINE

SYSTEMS FOR THE CONVEYANCE OF STANDING PASSENGERS

The present invention relates to systems for the conveyance of standing passengers, such as moving walkways and escalators.

Conventional walkway systems consist of ribbed belts, and conventional escalators consist of ribbed platforms to enable the use of a comb arrangement at the end of the walkway or escalator to bridge the gap with the termination plate to provide transition from the moving walkway or escalator onto the termination plate without ingestion of parts of the passenger's body, clothing, or other objects between the walkway or escalator and the termination plate. This method has been widely used throughout the world for many years. However the use of the rib and comb arrangement is not a fully satisfactory solution to the difficulties of achieving safe transition at the end of the moving walkway or escalator. For practical operation the comb teeth cannot mesh too closely with the ribs, gaps of 2 and 4 mm being common, and as a result, ingestion of passenger's clothing has occurred in some circumstances. Also the comb teeth are, by design, of relatively fragile construction so that if entrapment does occur, for example with a lace of a passenger's shoe, the teeth will break off rather than bend upwardly which would create a very dangerous obstruction. A significant problem arises when a tooth breaks off and leaves a gap into which, for example, a child's finger may intrude and be sheared off by movement of the travelling surface passing beneath the plate. There are a number of recorded instances of injuries occurring in this way. This is a potentially serious problem as replacement of broken teeth cannot be immediate.

The problem of comb teeth entrapment has been approached in conventional systems by making the termination plate movable in the direction of travel. Movement of the plate causes a switch to be tripped, which in turn stops the system. The problem is that the plate has to withstand, for example, the impact of an 80 kg man running onto it, without moving and causing the system to stop unnecessarily. The safety device is therefore necessarily insensitive, and this causes many problems.

Our earlier International patent application No. PCT/AU92/00163 provides a solution to the serious problem of entrapment between the surface of a moving walkway and a termination plate by using a flat belt entrained around a relatively small diameter roller at the end of the run of the belt. A critical relationship exists between the belt speed, roller diameter and position of the termination plate to ensure that successful transition will occur from the moving belt onto the stationary termination plate. However, in rare and unusual circumstances it might be possible for part of the clothing of a child sitting on the belt to enter into the gap between the termination plate and the belt. Our earlier patent application discloses a special shaping for the edge of the termination plate to facilitate removal in the unlikely event that ingestion occurs. The embodiment of FIG. 2 of this earlier application includes the use of a secondary plate, subject to a light spring bias, beneath the edge of the termination plate to block the gap with the edge of the belt in order to make ingestion even more unlikely. If, however, material is ingested between the moving belt and the lightly biased secondary plate, ingestion forces are small and extraction of the material is easy. If a sufficient body of material is ingested to displace the lower plate sufficiently to allow ingestion to take place between the moving belt and the termination plate the ingestion force will rise abruptly and extraction would become difficult to impossible. However, before this situation arises movement of the secondary plate initiates shut down of the system.

The termination plate arrangement disclosed in our earlier International patent application PCT/AU92/00163 is specific to a walkway system involving a flat belt and small diameter rollers. A termination plate arrangement in accordance with a first aspect of the present invention is applicable to a wider range of passenger conveyance systems. Specifically it is applicable to walkway systems using belts which pass over small or larger diameter end rollers, walkway systems comprising rigid pallets, and also to escalators.

Another potential safety problem which exists with moving walkways or escalators arises if the system is blocked or partially blocked at its discharge end by stationary objects or a stationary passenger. Such a situation can arise, for example, if luggage has fallen down an escalator or ramped walkway and accumulates at the termination plate at the end of the system. With existing systems involving the use of a rib and comb arrangements as discussed previously, a similar danger can also arise if a passenger is trapped by the termination plate. This type of situation is potentially quite dangerous as the continually moving walkway or escalator will continue to deliver further passengers to the zone where the blockage exists therefore compounding the potential problem. Although all escalators and walkways should be equipped with an emergency stop button, nevertheless it is likely that action to stop the walkway or escalator will not occur until there has been observation that a dangerous blockage has arisen and it is possible that appropriate action may not be taken to stop the system until some passengers have already suffered injury as a result of the blockage.

A second aspect of the invention therefore relates to the detection of relatively stationary objects or persons within the system. This aspect of the invention is applicable to all forms of walkway systems and escalators, including systems whose surface is formed by a series of small rollers closely adjoining each other, and existing walkway systems and escalators with ribbed or flat belts and platforms, as well as walkways or escalators in accordance with the first aspect of the invention.

According to the first aspect of the invention, there is provided a system for the conveyance of standing passengers comprising means defining a travelling surface of the system and a termination plate associated with the travelling surface, the termination plate having a leading edge which lies closely adjacent to the traveling surface at a position at which a passenger is discharged from the travelling surface, and detector means responsive to the sensing of matter ingested between the leading edge of the termination plate and the travelling surface whereby to stop movement of the surface in the event that ingestion of matter into a position adjacent the underside of the leading edge is detected.

Preferred embodiments in accordance with the first aspect of the invention thus incorporate means to detect the intrusion of material under the leading edge of the termination plate, and to then stop the system to allow any trapped material to be withdrawn. In practice, the plate will be mounted so that its leading edge is positioned as close to the moving surface as is practical, and generally within one to two millimeters.

The plate can be pivotally mounted so that when the system has come to a stop the plate may be lifted to allow any ingested material to be easily removed. The plate should be prevented from moving before the system stops as this would not only allow the greater ingestion of flexible material, but could result in the ingestion of solid objects such as the fingers of a child passenger, and could also—in the case of a lifting plate—provide an added obstruction to passengers being propelled off the preceding moving part of the system.

The detector means may comprise contact-sensing means such as a finger, bar, wire, rod or plate which is depressed or otherwise displaced by the ingested material, or non-contact sensing means such as a beam emitted by a light emitting diode, a filament lamp or a laser diode and which is interrupted by the presence of ingested material, or a switch which operates by detecting change of capacitance as a result of ingestion of material.

According to the second aspect of the invention, there is provided a system for the conveyance of standing passengers comprising means defining a travelling surface of the system, and means for detecting a blockage at a discharge end of the travelling surface whereby to stop movement of the surface if blockage occurs, said detecting means comprising means for determining the presence of relatively stationary objects or relatively stationary passengers at said discharge end.

The detecting means in accordance with the second aspect of the invention can take many different forms. In one preferred form relatively stationary objects near the end plate or transfer plate can be detected by measuring the time which passes between the appearance, at the measuring point, of the gap which separates sequential passengers. If this gap fails to reappear within a set time, the system assumes that a passenger or piece of luggage has stopped in front of the measuring point. An associated control system then brings the walkway or escalator to a stop.

The sensitivity of the detecting means will be enhanced if the "normal" or no accident gap is short, so that the system delay in determining that an abnormal situation has occurred is minimised.

In another preferred form, the detecting means operates on the basis of a comparison between the presence and/or absence of gaps detected between successive passengers and/or objects at a position on the system upstream of said discharge end with the detector of the same passengers and/or objects at said discharge end.

A detecting system which operates by obtaining vertical view of the travelling surface would maximise the responsiveness, as passengers standing one behind the other do not overlap, nor can they be hidden from the detector by accompanying baggage. However a vertical system using an energy source and a detector has the problem of keeping whichever one is facing upwards free of dirt. The lower device cannot be kept to the side to avoid the dirt problem because with such an arrangement an item of limited height, such as a stationary piece of luggage near the middle of the travelling surface, could remain undetected by the control system.

One solution to the overhead view problem would be to use an ultrasonic, optical time-of-flight or radar source looking down at the travelling surface, and detecting the travelling surface as it appears between sequential passengers, or their effects, as they pass off the end of the traveling surface. A number of devices will be needed, the total depending upon the minimum size of the relatively stationary object that it is necessary to detect. A number of narrow beams would be necessary in order to detect a relatively narrow object stopped at any point over the operating width of the system.

The simplest method is to look from the side of the travelling surface, and this can be done in at least two different ways. The simplest way is to send a beam from one side and which is detected on the opposite side. The beam could be emitted from, for example, a light emitting diode, a filament lamp or a laser. This beam would be interrupted by the passage of passengers and their baggage, and would be without interruption when the gap between objects appeared. The only serious limitation with this method is that, on wider systems particularly, passengers may be side-by-side and overlap, so that a clear view from one side to the other does not occur so quickly as it would if only the gap between passengers standing behind each other in single file were being measured. This may make the system insensitive, or could give rise to an unreasonable number of false stops.

However, if each of two detectors looks at only one half of the travelling surface, each would be looking for a gap between a single file of passengers. This would provide a more sensitive control system, but requires a different detection method. In this form a sonic, optical time-of-flight or radar beam can be used to detect the presence of passengers or goods closer than the middle of the system reflecting the beam, and when they are not being detected then a gap is assumed. A variation would be to measure the distance to the reflecting object, and a gap would be assumed if it is a greater distance away from the source of the beam than a point in the middle of the walkway or escalator.

The sources of the beams could be set opposite one another, as they can be tuned so that they do not interfere with each another.

Preferably, the beams are designed to determine that a gap exists on the half of the walkway or escalator they are monitoring by measuring the distance to the nearest object in their field of view and then, if "D" is the distance from the source to the centre of the moving surface, recording that a gap exists if either the distance to the object is greater than "D", or if there is no reflection from an object nearer than "D".

The possibility exists for a longer than normal time to elapse between the end of one gap and the beginning of another. An example would be someone wearing a floor-length coat of full cut, or delaying lifting up a long package until the last moment. In order to avoid stopping the system unnecessarily in these circumstances further detectors could be positioned upstream of the termination plate, where people will always be moving, and where a reference time for gap non-appearance could be determined. This reference figure could be fed into a logic control system to be used at the time that event would arrive, given the speed of the walkway or escalator, at the end plate detector(s).

A further refinement would be to have two sets of detectors positioned upstream of the termination plate, and not only obtain a reference time from one of them, but determine the time that the object took to travel from one to the other and so arrive at the speed of the object. This speed is used to determine the arrival time of the event at the termination plate detector(s) because, if the person is walking on the system, it may be a shorter time than that derived from a calculation based on system speed. However if the distance between the upstream and plate detectors is only of the order of one meter (as will usually be the case), this refinement is unlikely to be necessary.

The general logic used here could also be combined with a metal detection device, or a transponder and reader, to alert the system to the presence of a trolley approaching the deceleration zone of an accelerating walkway system. The problems of trolleys causing bunching problems could be reduced if the system was stopped or slowed if the trolley was detected as too close to the person in front of it to allow the compression which occurs during deceleration. That is the gap required between successive objects would be set at a different level when the presence of a trolley was detected as one of the objects.

In choosing the type of device to emit the beam, it should be noted that the more highly focused is the beam, the more sensitive will be the detection system. However highly focused beams, down to 2° or less, are more expensive than systems with a wider beam spread. Field trials will be needed to determine the most cost effective solution, however an 8° beam spread which gives a beam width of about 100 mm, 700 mm from the source would probably be effective. In this case 100 mm would be the minimum gap length, in the direction of travel of the system, that the beam would register as a gap.

The most effective height at which to mount the beam above the travelling surface will again be the subject of field trials, however a height of about 70 mm would seem to be optimum. The lower the mounting height the less likely it is that the beam will be reflected from carried luggage or wide parts of passengers clothing. The beam could be located only 10 mm above the surface if it was a simple laser looking from one side right across to the other. However a height of about 70 mm would be above the forepart of most shoes, and would therefore probably have the shortest normal passage time. In addition a height of this order would allow the use of only moderately focused reflecting beams, without the danger of them "seeing" the travelling surface. The lower part of the beam could be horizontal.

A different way of detecting that a person or object had come to rest in the vicinity of the termination plate is to mount a video camera above the escalator or walkway, continually recording the scene. A computer program could then continually analyse the picture, and from the algorithm of the program determine if any of the objects become relatively stationary.

Embodiments of the invention will now be described, by way of example only, with reference to the accompanying drawings in which:

FIG. 5 is a schematic plan view of a first embodiment of a system for detecting the presence of relatively stationary objects or persons at the discharge end of a walkway or escalator;

FIG. 6 is a schematic end view of the system shown in FIG. 5;

In each of the embodiments to be described herein reference is made to a termination plate of the system. It is to be understood that although this may be the end plate at the extreme downstream end (the discharge end) of a walkway or escalator, particularly in the case of walkway systems it may also be a transfer plate between two adjacent belts or sections of the walkway system.

Figure 1:
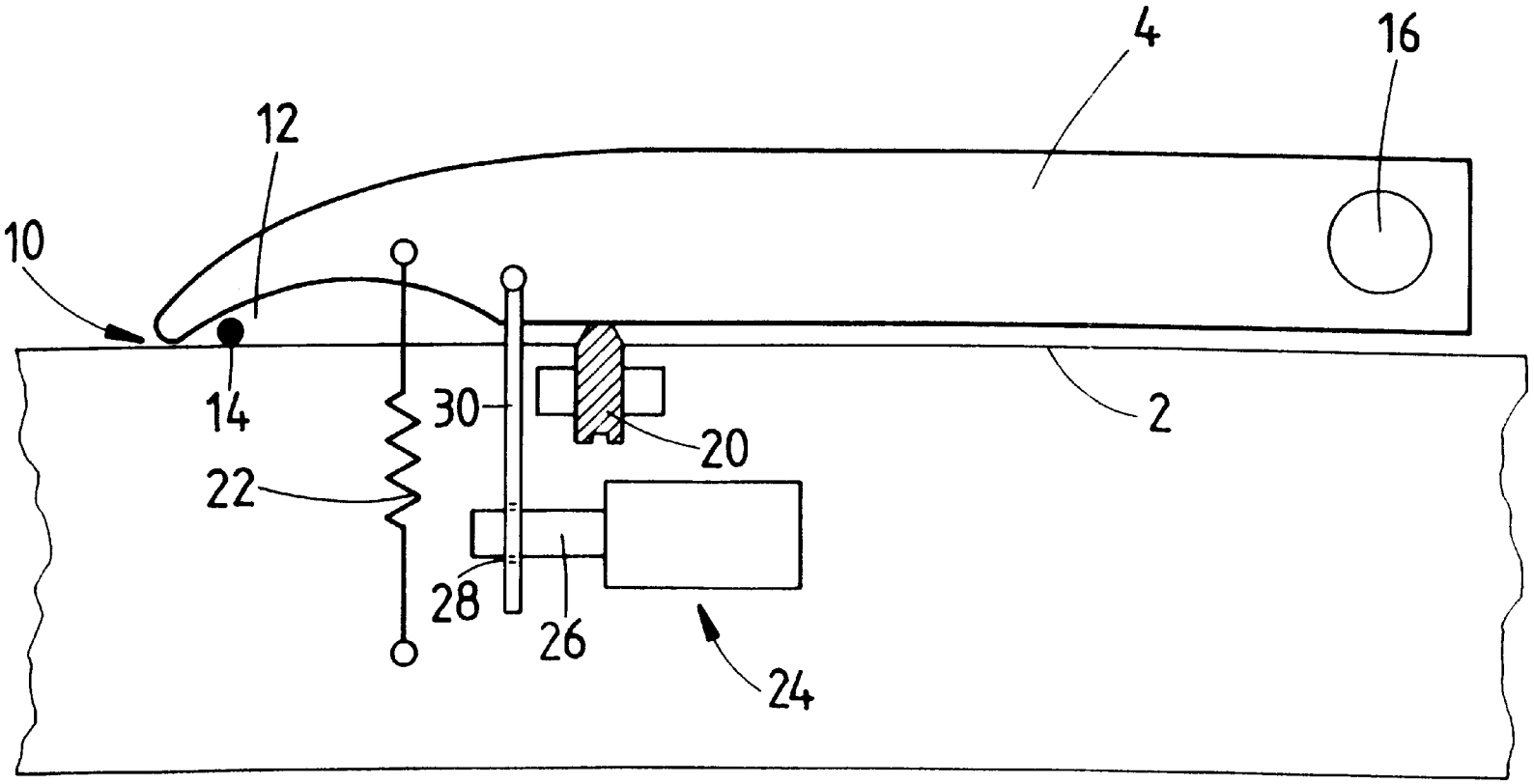
FIG.1 is a schematic side view of a termination plate configuration of a walkway system or escalator consisting of a series of interlinked rigid pallets.
Figure 2:
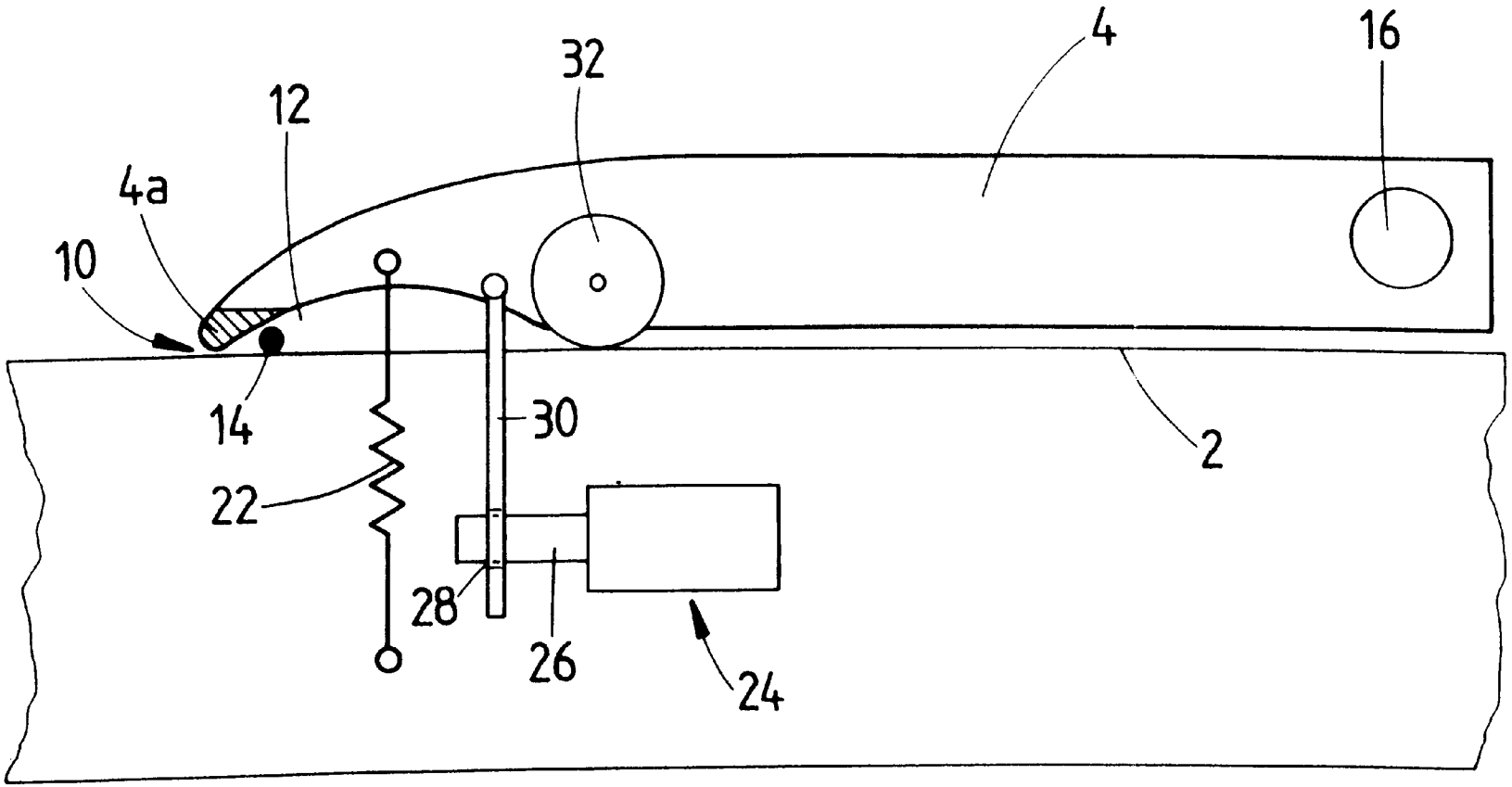
FIG. 2 is a schematic side view of a modified form of the system shown in FIG. 1.

FIGS. 1 and 2 show termination plate arrangements of a walkway or escalator consisting of metal or other rigid pallets so arranged that the full length of the pallet 2 must pass under the termination plate 4 before any part of the pallet surface commences to deviate from a line formed by the surface of the pallet when its leading edge passes under the leading edge of the end plate. While this line will usually be horizontal for escalators and some walkways, at the end of some sloped moving walkways the line may be inclined to the horizontal. Advantageously, the pallets 2 have flat (non-ribbed) surfaces.

Figure 3:
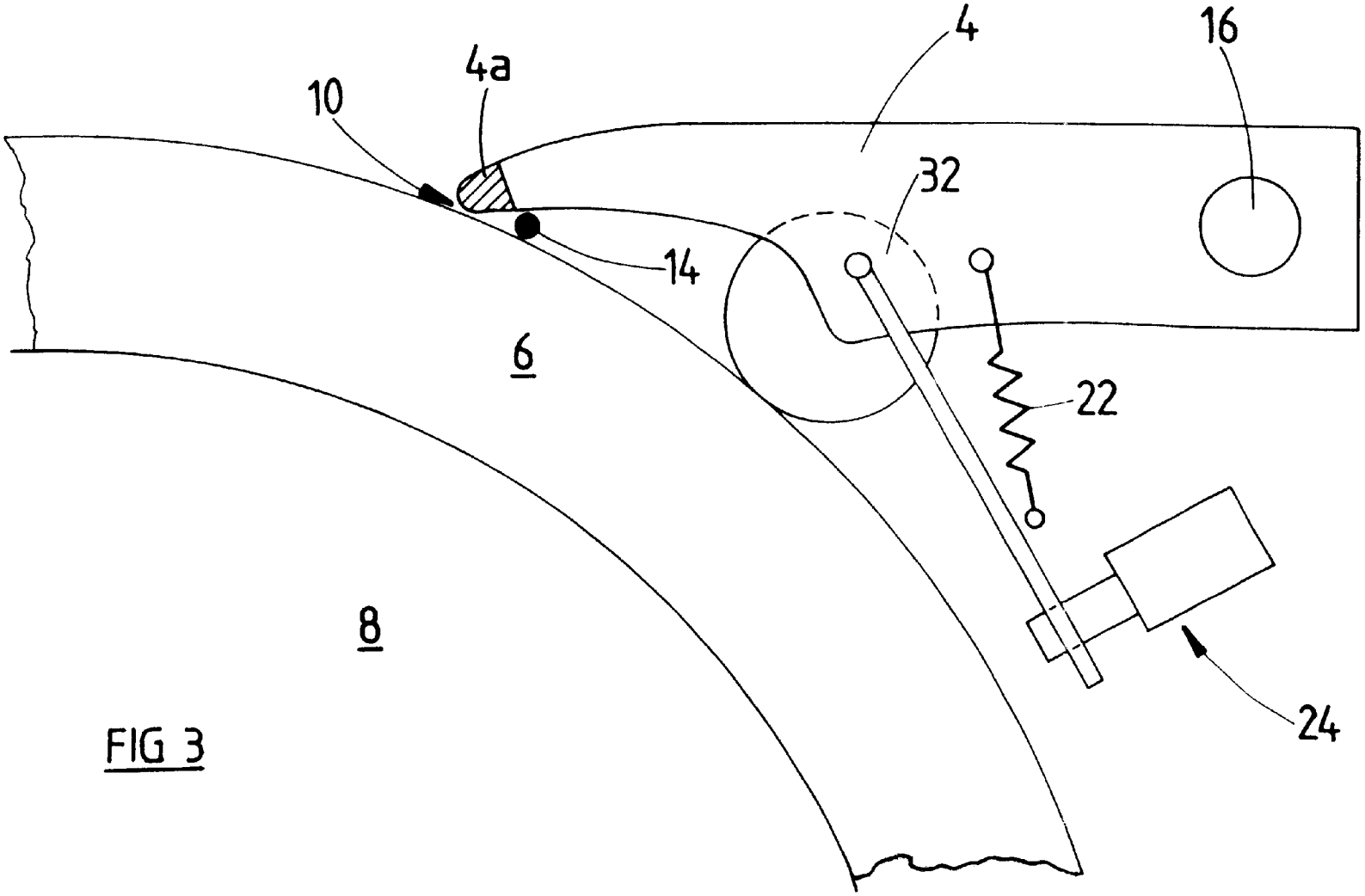
FIG. 3 is a schematic side view of a termination plate configuration for a walkway consisting of a flexible belt.
Figure 4:
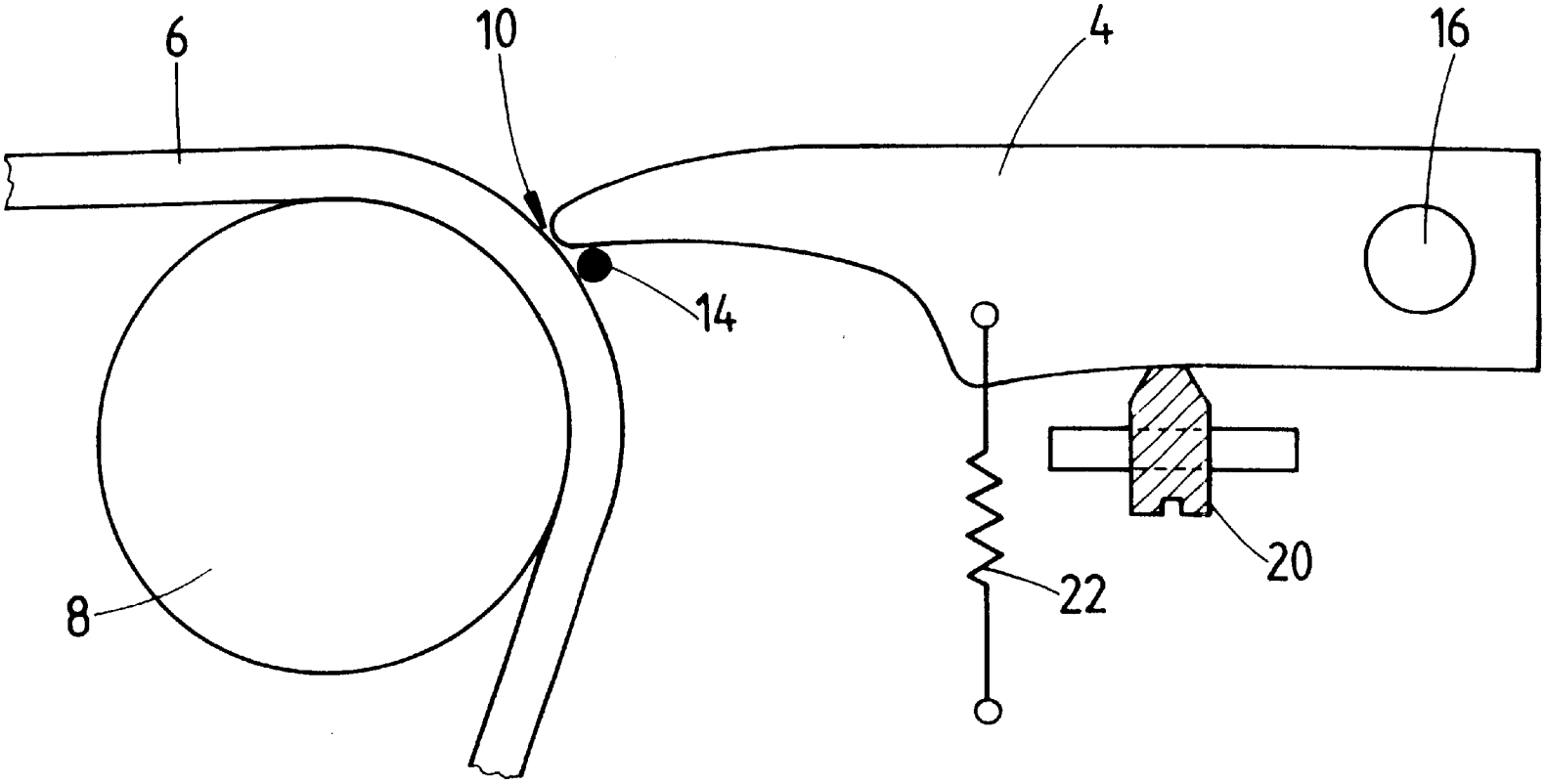
FIG. 4 is a schematic side view of an alternative form of the system shown in FIG. 3.

FIGS. 3 and 4 show termination plates adjacent to flexible belts 6 returning about rollers 8. Advantageously, the belts 6 have flat (non-ribbed) surfaces.

In each of the above embodiments passengers at the end of the system will normally step onto the termination plate, and if they do not, the toes of their shoes are normally a little above the ground and will ride up onto the end plate. Luggage is usually in the hands of passengers at this point. However small objects, or objects very close to the belt surface may impact the leading edge of the termination plate, and if flexible material is under the object it will be in a position where it may be ingested by the travelling surface moving under the plate. Solid objects, including the digits of children will be too small to enter the gap between the travelling surface and the plate. Very small objects such as grains of sand may pass under the plate without causing problems. To reduce the ingestion force between the pallet 2 or belt 6 and the plate 4, the leading end portion of the plate 4 is shaped to provide a nip 10 of small depth (typically, of the order of a few millimeters) with the surface of the pallet 2 or belt 6 as considered in the direction of travel. When used in relation to belts (FIGS. 3 and 4) the general shaping of the leading end portion of the plate 4 can be effected using the principles disclosed in our earlier International patent application No. PCT/AU92/00163. When used in relation to rigid pallets 2 (FIGS. 1 and 2) the nip 10 of small depth can be formed by shaping the underside of the leading end portion of the plate with a generally concave recess 12 in the manner illustrated in FIGS. 1 and 2. In either case, the effect of the shaping of the leading end portion of the plate 4 is to reduce the opposing surface areas of the leading end of the plate 4 and the pallet 2 or belt 6 which generate the ingestion forces at that point, in order to minimise those forces. However in the event that ingestion does occur, a detector system is incorporated immediately downstream of the nip point in order to detect presence of ingested material having passed through the nip point to a position adjacent the underside of the leading end portion of the plate. The detector system may comprise a detector beam 14, which could be a laser beam or other light beam or sonic beam positioned immediately downstream of the nip 10 such that it will be cut by any material ingested through the nip 10. Cutting of the beam will, in turn, activate a switch to stop operation of the walkway or escalator system.

The detector immediately downstream of the nip 10 could alternatively consist of means other than a beam and by way or example only, such means may consist of a wire spanning laterally across the underside of the plate at its leading end portion whereby the wire, when pushed forwardly by ingestion of material, activates a switch to which the wire is linked. Alternatively the detector may consist of a lightweight bar pivotally mounted at one end so as to be pivoted forwardly by ingested material and thereby activate a switch. As outlined previously other forms of non-contact detector can also be used. Irrespective of the actual form of the detector used it is to be noted that the detector will be incorporated immediately downstream of the nip point and the shaping of the plate at its underside is such as to accommodate the presence of the detector system.

Irrespective of the actual form of the detector used, advantageously the detector system is such that it is not responsive to the passage of small transient objects such as small pieces of loose material passing through the nip point. This effect can be achieved by requiring the detector to be responsive to presence of material for more than a predetermined time before operation of the walkway or escalator is switched off. By way of example only, the control circuitry associated with the detector may be set to require detection for a period of in excess of 0.25 seconds prior to deactivation of the walkway or escalator. This can be achieved very simply by incorporating an appropriate time-delay control function into the control circuitry and this may have the capacity for variation to suit the specific operating parameters of the system.

The operating principles described above are applicable to all of the embodiments of FIGS. 1 to 4. However each of these embodiments will now be discussed in greater detail.

In the event that ingestion through the nip point does occur and the walkway or escalator is stopped as a result of detection by the detector system discussed above, it is necessary for the ingested material to be removed. To facilitate removal, in each of the embodiments the plate 4 is mounted at 16 for pivotal movement about a horizontal axis so that it can be lifted away from the travelling surface of the walkway or escalator. However, the geometry of the embodiments of FIGS. 1, 2 and 3 is such that any material which does enter the nip point will tend to raise the plate 4 away from the surface of the walkway or escalator, potentially allowing the entry of further, larger, material and perhaps even parts of the human anatomy. Accordingly in each of these embodiments the plate 4 is prevented from moving at least to any significant degree away from the surface of the pallet 2 or belt 6 until the system has been switched off. For this purpose each of these embodiments incorporates means whereby the forward end of the plate 4 is maintained in close proximity to the surface of the pallet 2 or belt 6, associated with a positive locking device to prevent lifting movement of the plate by no more than a few millimeters until such time that the walkway or escalator has been stopped.

More particularly, in the embodiment of FIG. 1 an adjustable screw 20 is provided to limit the downward movement of the plate 4 to ensure that its leading end is kept very close to the travelling surface thus limiting the intrusion of material. The plate 4 is maintained against the screw 20 by a tension spring 22 which applies a downward bias to the plate 4. The plate 4 is also associated with a positive locking device 24 comprising a solenoid-operated bolt 26 which engages within a locking aperture 28 of a locking rod 30 depending from the plate 4. In the extended, locking, position of the bolt 26 as illustrated there is a small amount of play between the bolt 26 and the locking rod 30 which permits a limited amount of vertical movement of the plate 4, typically about 1 mm but no more than a few millimeters. This play will allow small movement of the plate 4 to facilitate adjustment. Preferably the locking solenoid is such that its inactivated state provides the extended locking position of the bolt 26 and in its activated state which occurs when the walkway or escalator is stopped as a result of ingestion being detected the locking bolt 26 is withdrawn to permit lifting of the plate 4 to release any material that may be trapped beneath the plate. Accordingly this aspect of the system is fail-safe as a power failure to the locking solenoid cannot result in potentially dangerous release of the plate.

The embodiment of FIG. 2 has an alternative means of controlling the gap at the nip point by means of a wheel 32 carried by the plate 4 and running on the pallet surface to which it is held by the spring 22. The wheel 32 ensures that the plate 4 follows the pallet surface which may rise and fall slightly when the system is in operation and which may gradually assume a lower average position as a result of wear of the wheels which support the pallets 2. By following the pallet surface, the wheel 32 keeps the leading end of the plate 4 in a constant relationship with the top surface of the pallet thereby ensuring maintenance of the small gap at this point. If the wheel 32 is made of metal and the surface of the pallet is of metal, noise generation arising from metal to metal contact could cause annoyance. If the pallet surface is covered with plastics, generated noise between the pallet surface and the wheel would be less and the wear on the wheel would also be much less but the wear of the pallet surface would be greater. If the wheel is made of a hard wearing plastics this would lead to a reduction in noise generation with a metal pallet surface but the wheel would wear more quickly than if it were made from a hard metal and the gradual wear could cause the tip of the plate to scrape on the pallet surface. However to cope with this possibility the tip portion 4*a* of the plate 4 at the part thereof immediately adjacent the pallet surface could be of a softer plastics than the wheel 32 so that if the tip does touch the pallet it will wear away without damaging the pallet and this will maintain substantially a zero gap at the nip point. This solution provided by complimentary wear rates of the wheel 32 and tip portion 4*a* is particularly advantageous as it not only reduces potential operating problems arising from noise generation but, importantly, will maintain virtually zero gap between the tip of the plate and the pallet as to greatly reduce the incidence of material ingested and completely eliminates the ingestion of any part of the human anatomy, and particularly a part of a child's body.

It is to be noted that the spring 22 which maintains the wheel 32 in contact with the pallet surface is only under a relatively light tension. If the spring 22 was under high tension it would accelerate the wear on the wheel and/or pallet surface by pressing it under excessive force against the pallet. However it is to be noted that although a spring under light tension could allow the plate 4 to be too easily lifted resulting in further ingestion of material and also perhaps becoming an obstruction to movement of passengers, the positive locking device as described above will prevent the plate 4 from being lifted while the system is in operation.

FIG. 3 shows a similar arrangement to FIG. 2 except applied to a walkway system having a belt 6 returning about a roller 8. The principles of plate tip design and supporting wheel design are the same as those just described in relation to FIG. 2. However the belt configuration provides more space to install ingestion detection devices and hence there is a wider range of possible detectors which can be used. By way of exnample an alternative detector which could be used with this embodiment can comprise a row of detector fingers extending radially of the roller 8 and so arranged that if any one of the fingers is depressed by ingested material, operation of the system would be stopped, subject to time-delay factors as discussed previously being incorporated to prevent stoppage of the system arising from the passage of transient pieces of material.

In the embodiment of FIG. 4 the placement of the plate 4 in relation to the belt 6 which is passing over a smaller diameter roller 8 than that of the embodiment of FIG. 3 will result in ingested material applying to the plate 4 a force which tends to move the leading end of the plate 4 downwardly rather than upwardly. The downwards force applied to the plate 4 tends to minimise the gap which minimises risk of ingestion and also requires only a light spring 22 to maintain the plate 4 in position but without the associated need for the positive locking device incorporated in the preceding embodiments due to the tendency of the plate 4 to be lifted by ingestion of material. In the embodiment of FIG. 4, the small diameter of the return roller 8 for the belt 6 means that it is not a feasible option to support the plate from the belt by use of a wheel as described in relation to the embodiments of FIGS. 2 and 3. Instead in this embodiment an adjusting screw arrangement similar to that described in relation to FIG. 1 is used. It is to be noted that in the event of ingestion occurring, the downwards force applied to the plate 4 as a result of ingestion will be resisted by abutment with the adjusting screw 20. Because in this configuration the nip depth is extremely small, if the leading edge of the plate 4 does happen to contact the belt 6, the resultant wear on the belt 6 is likely to be extremely small and accordingly in this embodiment it may be possible to adjust the system so that the edge of the plate 4 is much closer than that in the preceding embodiments except in situations where the system is designed to allow the tip portion of the plate to wear away as a result of differential wear between the tip and supporting wheel as discussed earlier.

In the preceding embodiments ingestion of material into a position adjacent the underside of the leading edge of the plate is detected by a contact or non-contact sensor directly responsive to the presence of the ingested material. However it will be appreciated that ingestion of material into a position adjacent the underside of the leading edge of the plate will also result in generation of a force which will act upwardly in the embodiments of FIGS. 1 to 3. Accordingly, in these embodiments an alternative detection method can operate in response to sensing of the upwards force which arises on the plate when ingestion occurs. A convenient method of detecting this upwards force can be achieved by incorporating a pressure transducer on the locking rod 30, the pressure transducer interacting with the bolt 26 as a result of an upwards force applied to the plate and hence the locking rod 30 as a result of ingestion occurring, the pressure transducer thereby generating a signal to shut-down the system. It is however to be understood that other arrangements of force or pressure detecting means can be used to sense the upwards force applied to the plate arising from ingestion into a position adjacent the underside of its leading edge.

Detection of ingestion by sensing an upwards force on the plate when ingestion occurs can, to advantage, also be applied to conventional walkway or escalator systems incorporating a rib and comb arrangement. For this purpose the plate is formed at its leading end portion with comb teeth which mesh with the ribs of the belt or pallets. However in contrast to conventional rib and comb systems, the comb plate or at least the part of the comb plate including the teeth is mounted for pivotal movement about a horizontal axis. The plate is spring biased into its lower operative position and is normally retained in that position by a suitable locking system, for example comprising a solenoid-operated locking bolt and locking rod as described above. Suitable force or pressure detecting means are incorporated to sense upward force applied to the plate arising from ingestion of matter into a position adjacent the underside of the comb teeth, or beneath the body of the plate forwardly of the teeth if any of the teeth are missing, to thereby shut off the walkway or escalator and also effect release of the locking system. The force or pressure detecting means can consist of a pressure transducer interacting between the locking rod and locking bolt as described above. An ingestion-responsive comb plate arrangement as just described can to advantage be retrofitted to existing walkways or escalators using ribbed belts or pallets simply by removing the existing comb plate and replacing it by a comb plate arrangement as just described, the components such as the biasing spring and locking system being installed in the space available at one or both sides of the travelling surface.

It is clearly to be understood that the plate arrangement of FIGS. 1 to 4 described above may exist at the discharge end of a walkway or escalator whereby the plate itself is an end plate, or between two adjacent sections of a system, particularly of a walkway system between different belts between belts and rollers or other travelling surfaces in which case the plate constitutes a transfer plate between the different travelling surfaces.

The plate arrangement of FIGS. 1 to 4 can, to advantage, be retrofitted to existing walkways or escalators consisting of ribbed belts or ribbed pallets by removing the existing comb plates and filling the gaps between the adjacent ribs with suitable filler and/or by covering the surface of the existing belt or pallets so as to provide a substantially flat travelling surface.

FIGS. 5 and 6 show a first embodiment of a system for detecting the presence of relatively stationary objects at the discharge end of a walkway or escalator system (or of a section of a walkway system) as may arise as in the event of a blockage occurring, for example as a result of an accumulation of luggage or a passenger falling at the end of the system. It is to be noted that although the system of this and the following embodiments can be used in conjunction with the embodiments of FIGS. 1 to 4, it is not restricted to such use and has wide applicability in all existing walkway and escalator systems consisting of ribbed or flat, belts, or rollers.

The detector system of FIGS. 5 and 6 comprises a primary, downstream, detector 100 arranged at the discharge end of the walkway or escalator 102 (or section thereof) where blockage is first likely to arise, and a secondary, upstream, detector 104. The secondary detector 104 is arranged upstream of the detector 100 to monitor "normal" operation of the system prior to blockage arising at the discharge end. The spacial relationship between the upstream and downstream detectors 104 and 100 is such that the upstream detector 104 should be sufficiently close to the downstream detector 100 such that a "normal" operating condition sensed by the upstream detector 104 is not likely to change greatly prior to reaching the downstream detector 100, whereas it should not be so close to the downstream detector 100 that an abnormal operating condition sensed by the downstream detector 100 as will occur in the event of blockage will almost immediately be sensed by the upstream detector 104. Although the exact distance will depend on the operating parameters of each individual system, for most systems it is envisaged that the secondary detector 104 would be positioned about one to two meters upstream of the primary detector 100.

Both detectors 100, 104 operate on the principle that during normal operation of the system, moving passengers and luggage will create a series of "gaps" which can be sensed by a detector looking transversely across the system. Although the length of the gaps will be dependent on how many people are using the system at any one time and the amount of luggage on the system, nevertheless even with a system carrying a large number of people as may occur during peak travel times, there will still be detected a fairly rapid sequence of "gaps" between adjacent passengers and luggage. The regular detection of gaps and then persons or luggage will indicate a normal situation in which there is no blockage in the system. However in an abnormal situation where blockage is occurring, luggage and/or passengers will remain relatively stationary and hence the absence of a sensed gap for more than a predetermined time will be indicative that at that point, specifically the discharge point of the system, a blockage has arisen and hence the overall system should be stopped.

In a first embodiment of this detector system principally for use with relatively narrow walkways or escalators where the passengers are likely to be in a single row, in other words systems wherein there is insufficient available space for two or more passengers to comfortably travel side-by-side, the primary detector 100 consists of an emitter 100*a* at one side of the travelling surface and a receiver 100*b* at the opposite side. The emitter 100*a* emits a beam of energy towards the receiver 100*b*, for example a source of light energy whether or not within the visible spectrum, a laser beam or a sonic beam. The receiver 100*b* is responsive to the beam in the presence of a gap appearing. Accordingly the primary detector 100 is able to monitor the occurrence of a succession of gaps as passengers and/or their luggage move past the detector at the discharge end of the system. The sensing of a regular succession of gaps at this point will be indicative of normal operation of the system. Conversely if, over a period of time no gap is detected, this will be indicative that a blockage has arisen whereby the system is then stopped. It may well be satisfactory to have a detection system of this type whereby the walkway or escalator system is switched off if a gap is not detected for a predetermined period of time, for example 1 to 2 seconds, in which case the operating parameters of the detector may need to be set to provide for a sufficiently long interval between the sensing of gaps as may arise during certain conditions of normal operation even without blockage in order to prevent stoppage of the system under those circumstances. However if the time required to prevent stoppages, even when there were no blockages, is much above one second a further set of detectors can be used.

We therefore propose as an alternative a secondary detector 104 which likewise consists of an emitter 104*a* and receiver 104*b* located upstream of the primary detector 100 to set the operating parameters of the primary detector 100. As previously mentioned, the secondary detector 104 is located at a position such that in the event of blockage occurring in the vicinity of the primary detector movement past the secondary detector will not be effected for a finite period of time, say a few seconds. Conversely however the secondary detector is sufficiently close to the primary detector that, under normal movement conditions not subject to blockage a movement situation of passengers or luggage sensed by the secondary detector will not change to any appreciable extent by the time the same passenger and luggage has reached the primary detector except that as passengers start to walk off the system they will both have larger gaps between them and these gaps will occur more quickly; this can be allowed for in the control circuitry of the system. Accordingly the secondary detector will sense a succession of gaps as passengers and luggage move past the secondary detector. Although the succession of gaps sensed by the secondary detector will be highly variable depending on a range of factors such as the size and positioning of any luggage in relation to the passenger, the size of the passenger and possibly even the type of clothing the passenger is wearing, nevertheless in a normal situation where no blockage is occurring, an interval of a particular passenger and luggage (or perhaps even a group of closely adjacent passengers and luggage) as sensed by tne secondary detector would also be sensed by the primary detector without substantial variation subject to there being no blockage. Accordingly control circuitry for the detector system operates on a comparison between gap time spacing as sensed by the secondary detector 104 and equivalent gap time spacing as sensed by the primary detector 100 shortly thereafter as the same passenger and luggage arrive at the primary detector. If the gap time spacing as sensed by the primary detector is greater by more than a predetermined amount than that sensed by the secondary detector, say more than 0.5 to 1.0 seconds greater the detector system will then generate a signal indicative that blockage has occurred and stoppage of the walkway or escalator system can then be effected in response to that signal.

In walkway or escalator having a width whereby it is likely that two or more passengers may stand side-by-side, the use of a detector in the form of an emitter at one side of the system and a receiver at the opposite side to detect the beam when the gap exists will not be feasible. Accordingly in an alternative embodiment of the system the primary detector consists of a respective emitter and receiver unit at each side of the walkway or escalator. The emitter part of each unit emits a beam which, on encountering an object, is reflected back to the receiver part of the unit. In effect therefore each emitter/receiver unit scans one half of the width of the walkway or escalator and the time taken by the reflected beam to return to the receiver part of the unit will be indicative of whether a person or object is moving on that half of the system past the detector or whether a gap exists at that point. Clearly, in the event of a passenger or object being on the adjacent half of the system, the reflected beam will return to the receiver part more quickly than if a gap exists on that part of the system whereby the beam will not be reflected until it meets a passenger or object on the far half of the system or an opposing side wall of the system. The emitter/receiver units at the opposite sides of the walkway or escalator are tuned to ensure that there is no interference between the respective beams emitted from opposite sides.

Figure 7:
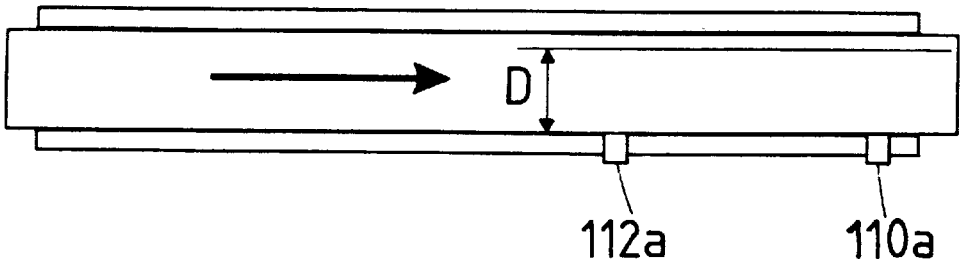
FIG. 7 is a schematic plan view of a second embodiment of a system for detecting the presence of relatively stationary objects or persons at the discharge end of a walkway or escalator.
Figure 8:
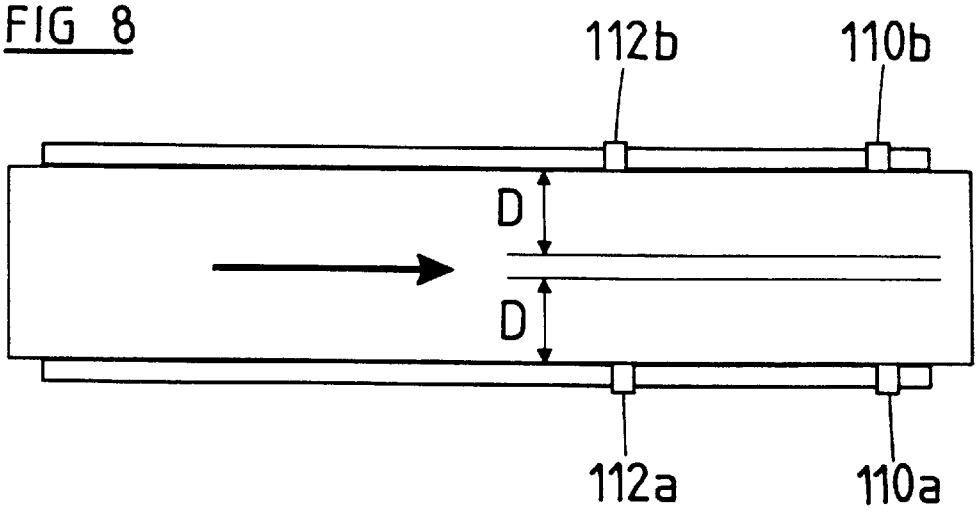
FIG. 8 is a plan view similar to FIG. 7 but showing the applicability of the system to wider walkways or escalators.

FIGS. 7 to 14 show in detail another embodiment of a blockage detector system, including a circuit diagram (FIG. 9) and flow charts (FIGS. 10 to 14) of the detection procedure. FIG. 7 shows a narrow walkway or escalator using a downstream detector 110*a* and upstream detector 112*a* at one side of the travelling surface. FIG. 8 shows a wider walkway or escalator using downstream and upstream detectors 110*a*, 110*b*; 112*a*, 112*b* at both sides of the travelling surface.

Figure 9:
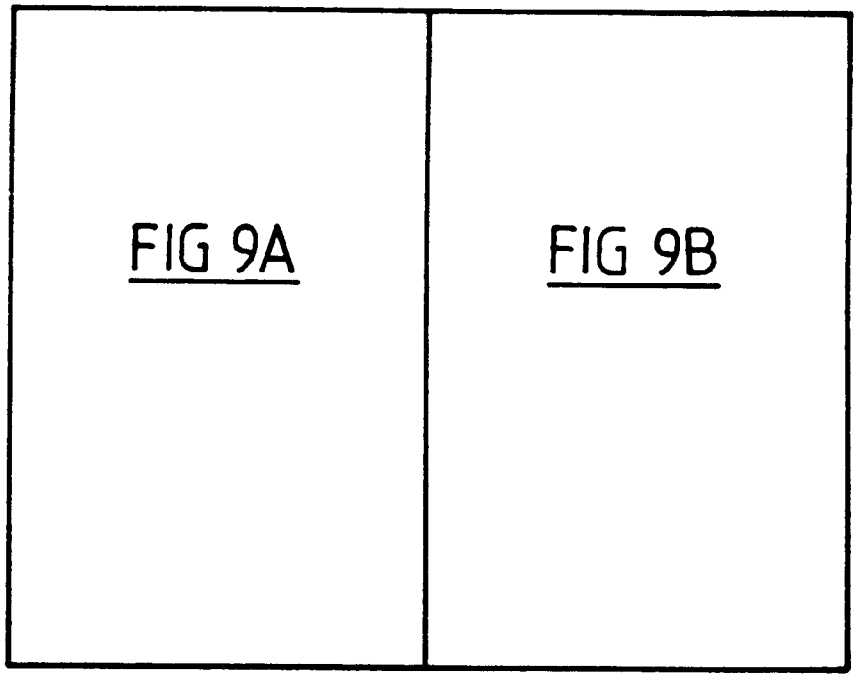
FIGS. 9, 9A and 9B are circuit diagrams of the detector system of the second embodiment, FIG. 9 being an explanatory diagram showing the relationship between FIGS. 9A and 9B which together constitute the circuit diagram.
Figure 9A:
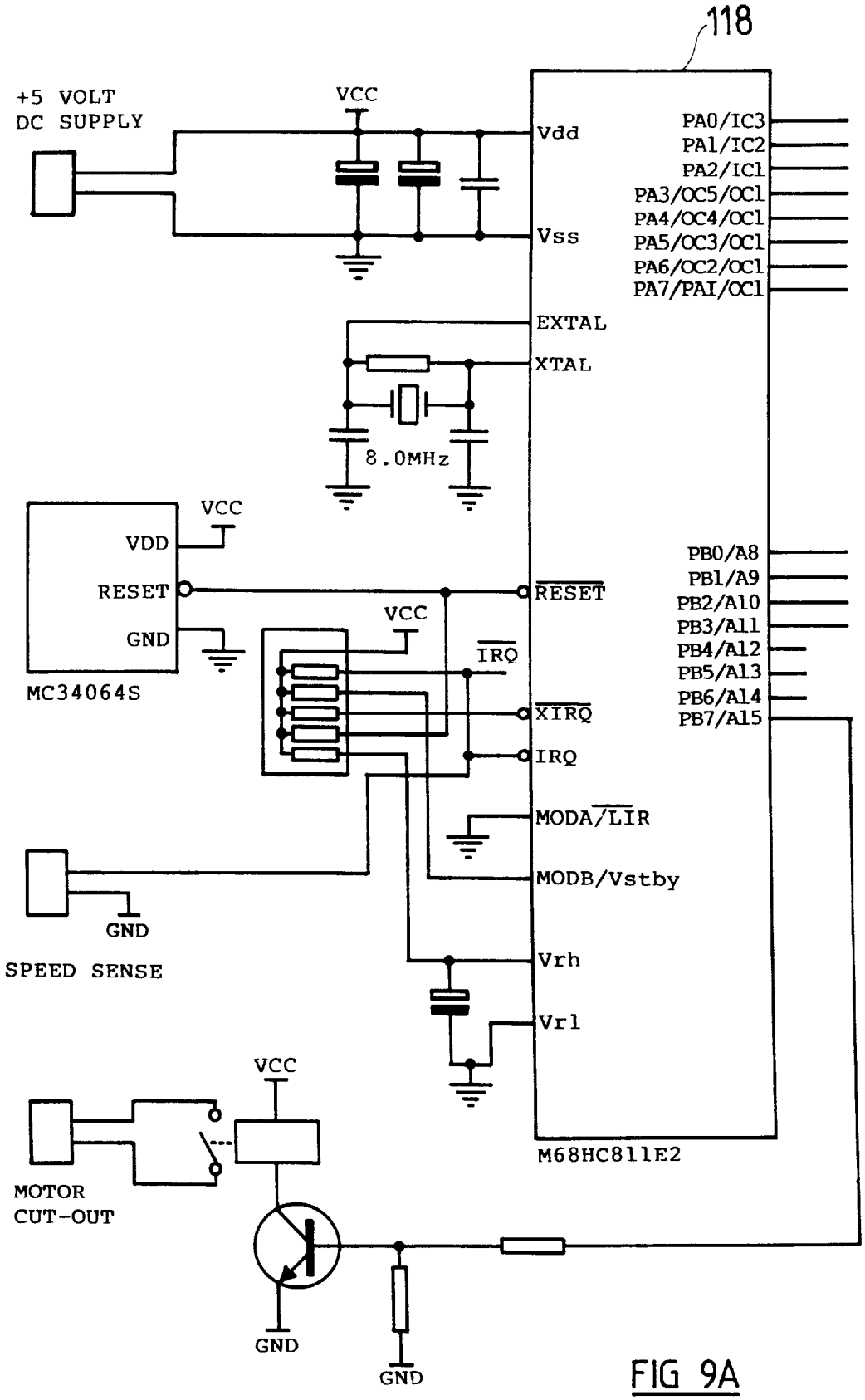
Figure 9B:
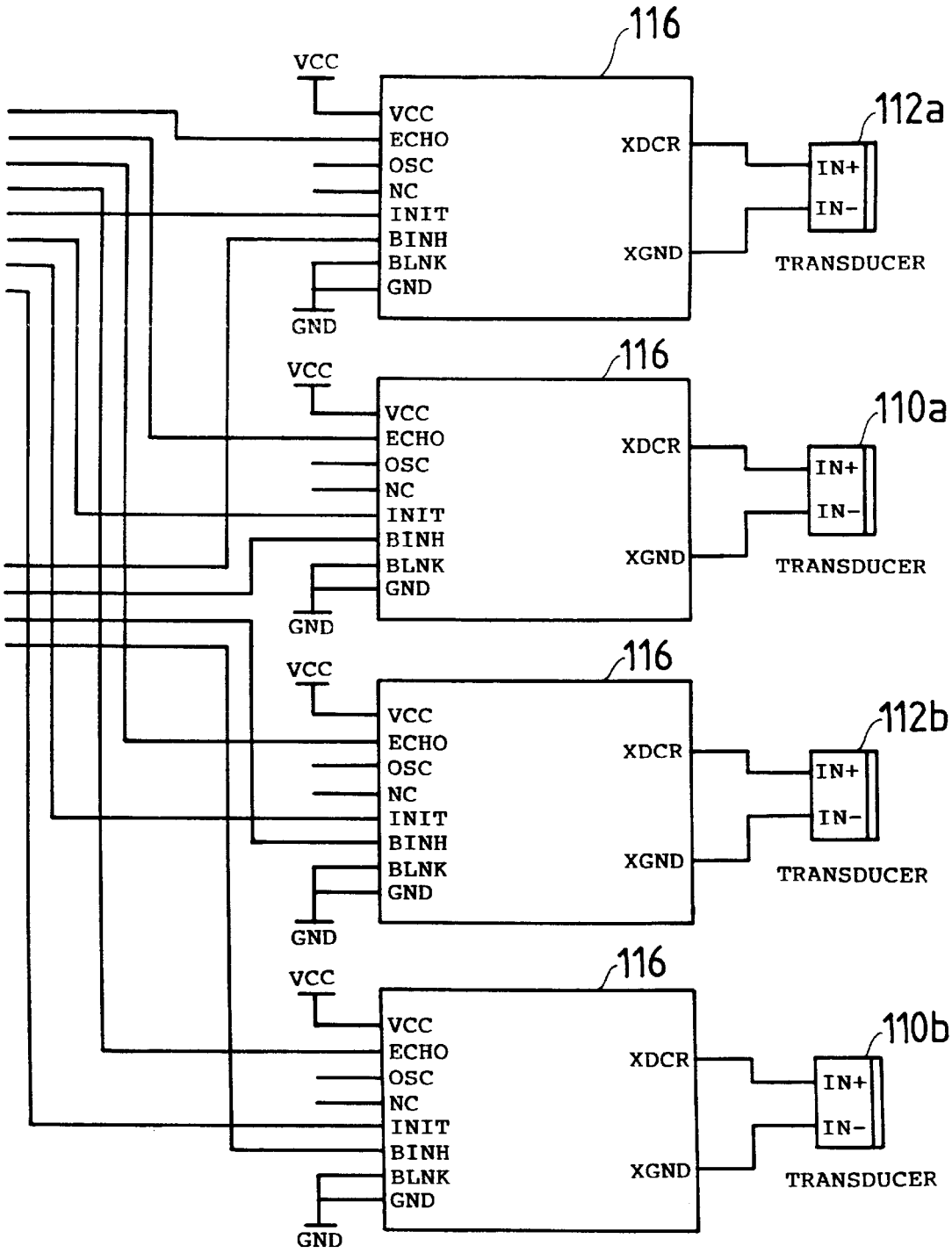

In this preferred embodiment the detectors 110*a,b*; 112*a,b* each consist of a Polaroid Series 7000 instrument-grade ultrasonic transducer driven by a Texas Instruments SN28827 ultrasonic driver module 116 (see FIG. 9). Information provided by the detectors is read by a computation means 118 which is comprised of a Motorola MC68HC811 microprocessor with ancillary components as shown in the circuit diagram of FIG. 9.

Distance readings are taken from detectors 112*a* and 110*a* every one-tenth of a second. Detector 112*a* provides information regarding the occurrence of gaps in between objects and people on the walkway. This information is fed into a FIFO (first in first out) queue whose delay time corresponds to the time taken for an object to move the distance from detector 112*a* to 110*a* under normal operating condition. This delay time depends on the speed of the walkway which is measured by the microprocessor. The length of the FIFO is adjusted automatically to account for walkway speed variations.

Readings from detector 112*a* exit the FIFO after the travel-time delay and are compared with current reading from detector 110*a*. If the delayed information from detector 112*a* indicates that detector 110*a* should be detecting a gap while detector 110*a* is actually detecting an object then a counter is incremented. If this counter exceeds a pre-programmed value then the system motors are shut down.

A more detailed description of the detection procedure follows.

Figure 10:
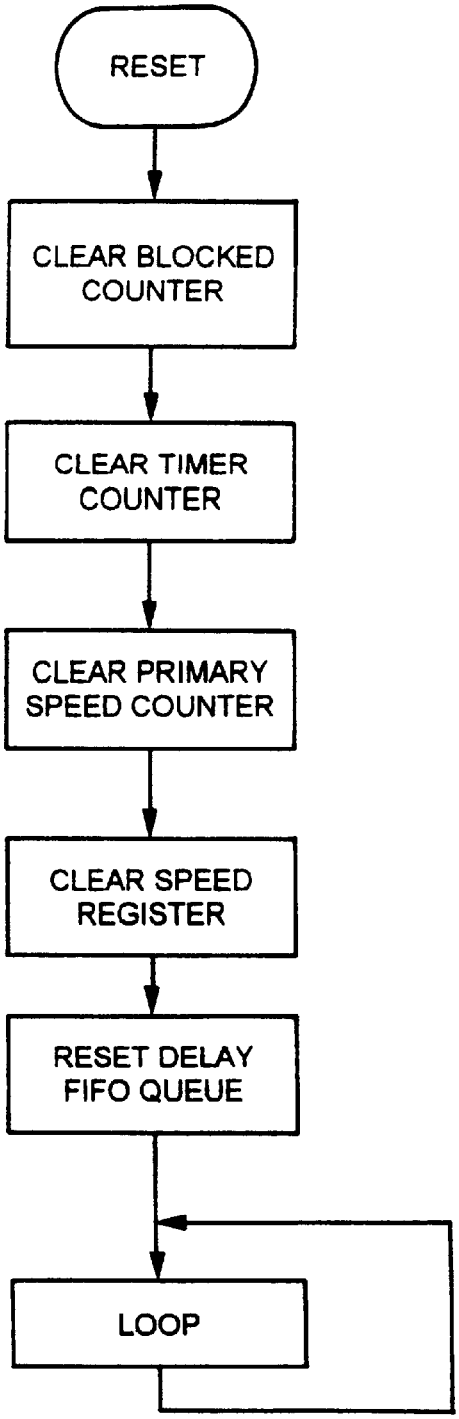
FIGS. 10 to 14 are flow charts explaining the detailed operation of the detection procedure in the second embodiment.

When power is applied or the microprocessor is reset, then a reset and idle loop code is executed as shown in flow chart 1 (FIG. 10). The blocked, primary speed and time counters are cleared along with the speed register and the FIFO queue. Thereafter, the microprocessor simply executes an infinite program loop waiting for interrupt events to occur.

Figure 11:
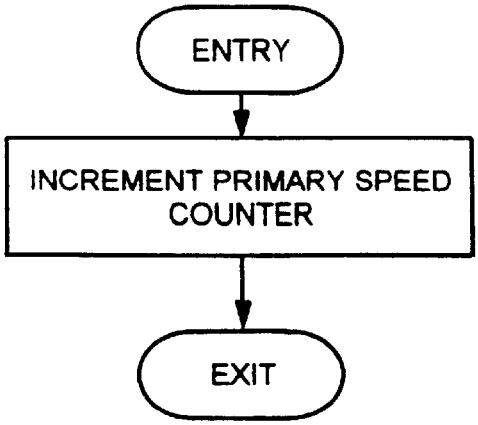
Figure 12:
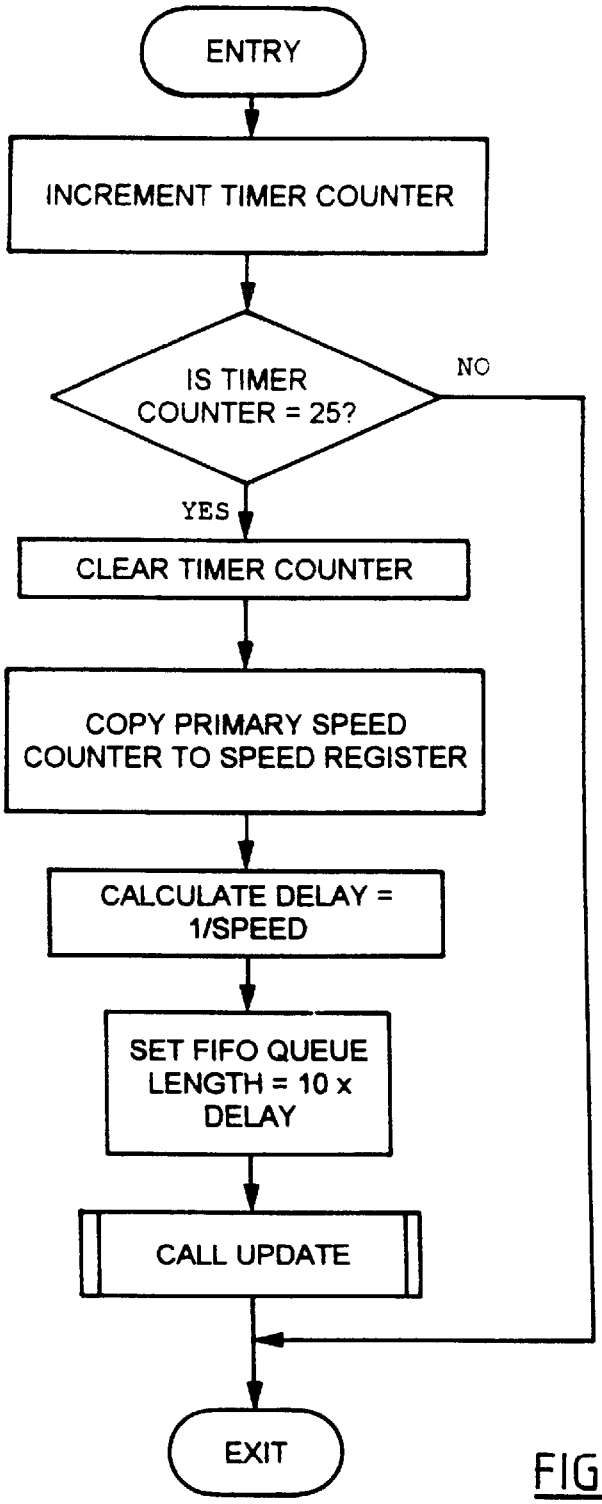
Figure 13:
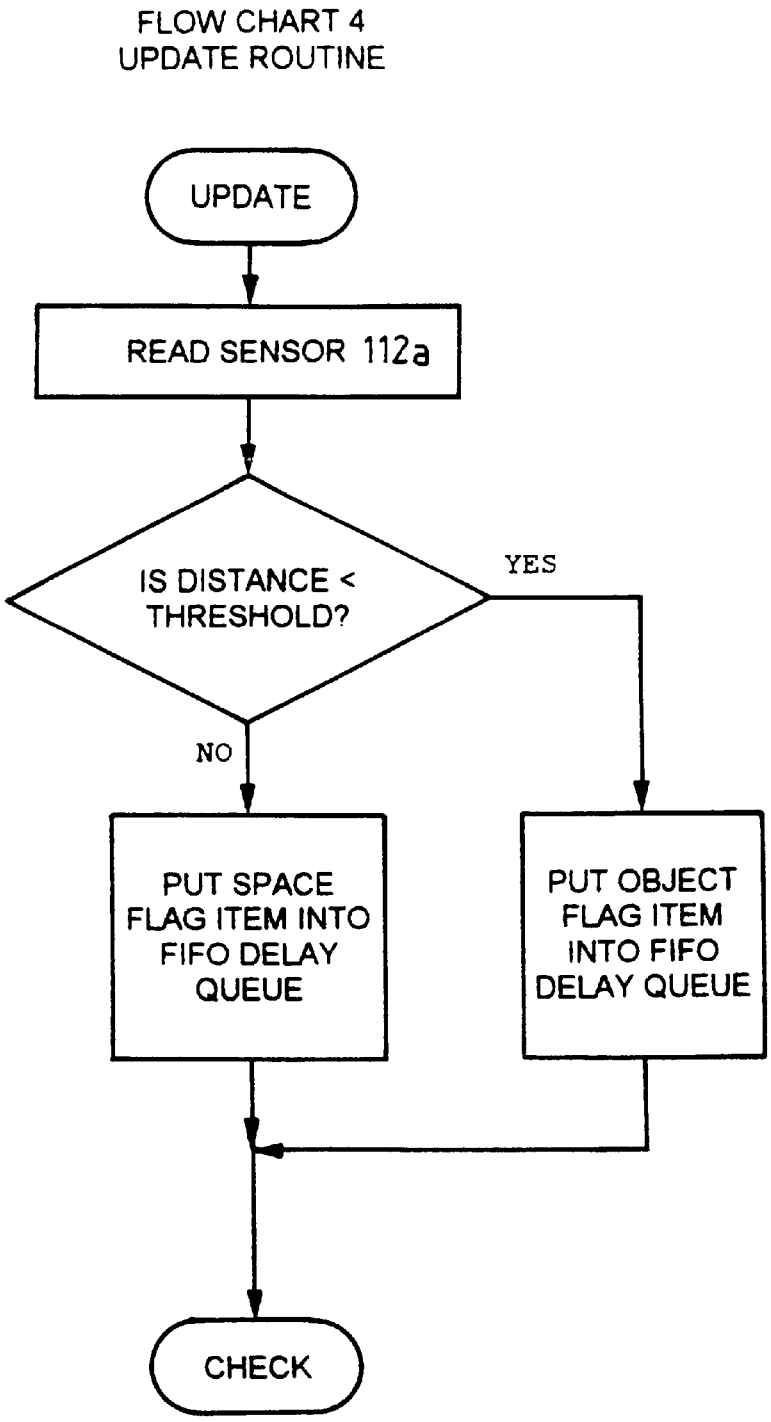
Figure 14:
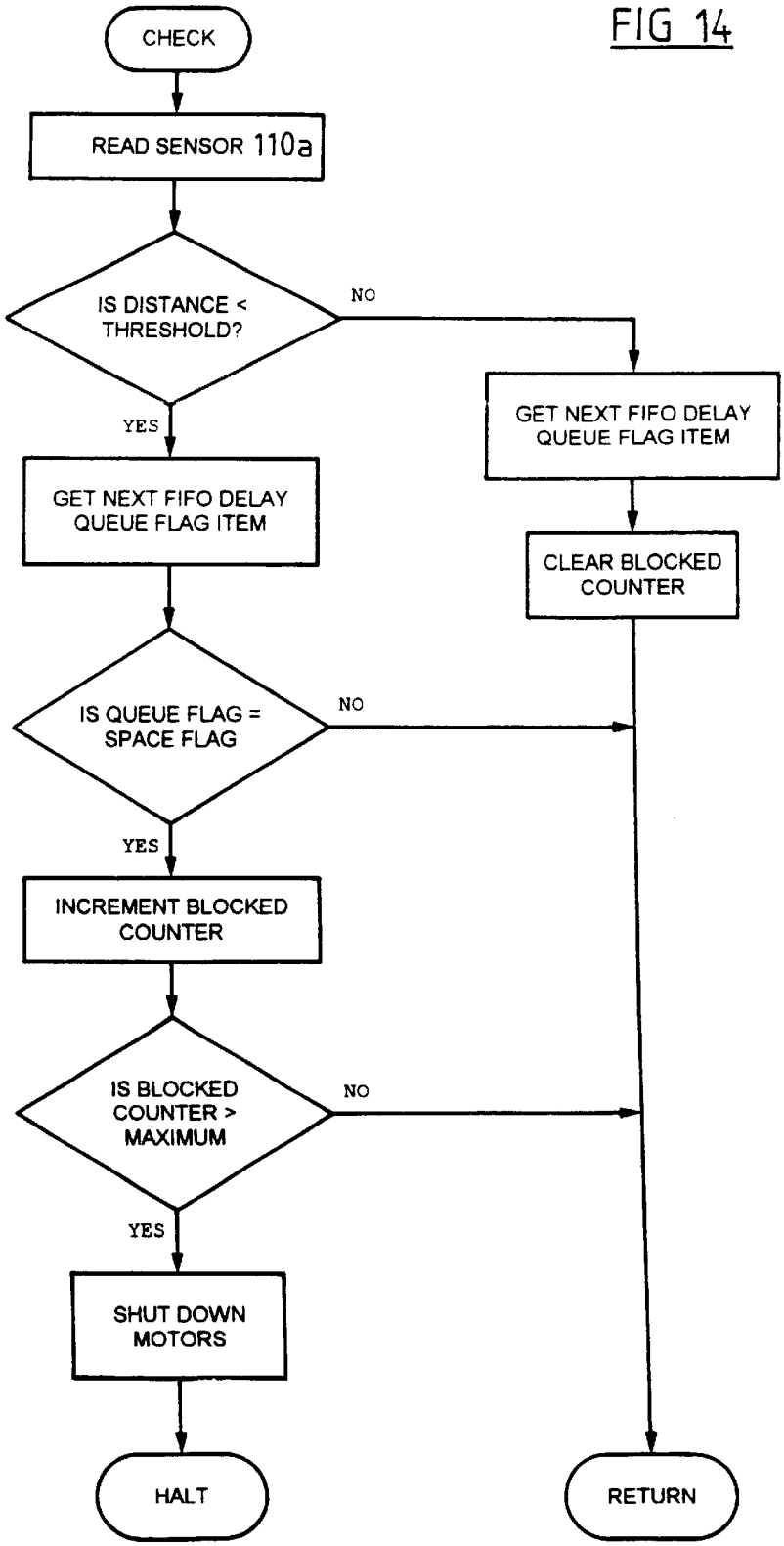

Walkway speed is determined by counting speed pulses through the speed sense interrupt routine which is shown in flow chart 2 (FIG. 11). A second interrupt source is the real-time interrupt shown in flow chart 3 (FIG. 12). This routine is activated at approximately 4 millisecond intervals by a hardware timer built into the microprocessor. At every 25th timer event, the belt speed and consequent FIFO queue length are calculated and the main detection routine, called update, is executed.

In the update routine shown in flow chart 4 (FIG. 13), a reading is taken from detector 112*a* and compared to a distance threshold D which is shown in FIGS. 7 and 8. In the case of FIG. 7, D is slightly less than the width of the walkway whereas in FIG. 8 it is slightly less than half the width of the walkway. If the distance detected is less than D then an "object flag" item is placed in the FIFO queue indicating that an object was detected otherwise a "space flag" item is placed indicating that no object was present.

The update routine then passes on to the check routine which is described in flow chart 5 (FIG. 14) which determines whether or not a blockage incident has occurred. In this routine, detector 110*a* is read. If the detected distance is less than the threshold D, then the next item from the FIFO queue is retrieved. If this item is a space flag then the blocked counter is incremented. If the blocked counter is then found to have exceeded a pre-programmed value, then the motors driving the walkway or escalator are shut down.

If, on the other hand, detector 110*a* detects a space then an item is retrieved from the FIFO queue to ensure that the correct FIFO delay is maintained and the blocked counter is cleared. The FIFO item is ignored in this instance.

Although the detection can be achieved with a minimal system comprised of two ultrasonic detectors as shown in FIG. 7 a more robust embodiment is achieved by the additional use of the second pair of detectors placed opposing the first pair thus constituting a 4-detector system as shown in FIG. 8 which avoids problems caused by shadowing. In the case of the 4-detector system, detectors 112*b* and 110*b* perform as a pair in an identical manner to 112*a* and 110*a*. Therefore the flow charts describing the operation of detectors 112*a* and 110*a* equally apply to the pair 112*b* and 112*a*.

Although detection of possible blockage by detecting the presence and/or absence of gaps between passengers and/or objects on the system as described above represents a detection system which can be implemented relatively inexpensively, detection could also be effected in other ways. For example, using a video camera mounted above the discharge end of the system, a continuous succession of images of the discharge end can be formed. In a normal operating situation passengers or objects such as luggage will be seen to move substantially continuously in the direction of movement of the system, but in the event of a blockage, such movement will not occur. Object detection or identification algorithms implemented in computer software using image data as an input can determine the presence of an object (a passenger, luggage, or the like) in the image. Over a series of images the software can then determine whether or not the object remains in the image field of view. Even if the object boundaries vary, the detection algorithm should be able to determine whether or not it is the same object. It is well within the capabilities of those skilled in the art to develop appropriate software for this purpose.

The embodiment has been described by way of example only and modifications are possible within the scope of the invention.

What is claimed is:

1. A comb plate arrangement for use with a walkway system comprising a ribbed travelling surface, said comb plate arrangement comprising a comb plate having comb teeth arranged to intermesh with the ribs of the travelling surface, means mounting the plate for pivotal movement about a horizontal axis so that the plate can pivot between a lowered operative position in which the teeth mesh with the ribbed surface and a raised inoperative position, spring means for biasing the plate into its operative position, releasable locking means for retaining the plate in its lowered operative position, means for detecting an upwards force applied to the plate in the event of ingestion of matter beneath the teeth, and control means operative to shut off operation of the travelling surface and to effect release of the locking means in the event that ingestion is detected.

2. A system for the conveyance of standing passengers comprising means defining a travelling surface of the system, said surface having an exposed section along which passengers move during normal operation of the system, and means for detecting a blockage to movement of passengers at a discharge end of the exposed section of the travelling surface whereby to stop movement of the surface if blockage occurs, said detecting means comprising means for sensing the presence of relatively stationary objects or relatively stationary passengers on said exposed section at said discharge end.

3. A system according to claim 2, wherein the detecting means is operative to sense the presence of stationary objects or stationary passengers by sensing on a comparative basis the presence and/or absence of gaps which would occur between successive passengers or successive objects during normal operation of the system.

4. A system according to claim 2, wherein the detecting means operates on the basis of a comparison between the presence and/or absence of gaps detected between successive passengers and/or objects at a position on the system upstream of said discharge end with the detector of the same passengers and/or objects at said discharge end.

5. A system according to claim 4, wherein the detecting means comprises means for sensing the presence and/or absence of gaps between passengers and/or objects on each of two respective half widths of the travelling surface.

6. A system according to claim 2, wherein the detection means comprises means for forming images of said discharge end, means for determining the presence of an object in the image, and means for detecting movement of said object in the direction of movement of the system over a succession of said images.

* * * * *

UNITED STATES PATENT AND TRADEMARK OFFICE

CERTIFICATE OF CORRECTION

PATENT NO. : 6,241,070 B1
DATED : June 5, 2001
INVENTOR(S) : John Louis Loder

It is certified that error appears in the above-identified patent and that said Letters Patent is hereby corrected as shown below:

Column 14, claim 5,
Line 64, "according to claim 4, wherein" should read -- according to claim 3, wherein --.

Signed and Sealed this

Nineteenth Day of February, 2002

*Attest:*

*Attesting Officer*

JAMES E. ROGAN
*Director of the United States Patent and Trademark Office*